US006860124B1

(12) United States Patent
Abi-Habib et al.

(10) Patent No.: US 6,860,124 B1
(45) Date of Patent: Mar. 1, 2005

(54) WASHING MACHINE BRAKE CAM ACTUATOR WITH INTERRUPTED RING

(75) Inventors: Emile Edward Abi-Habib, Louisville, KY (US); Stephen Bernard Froelicher, Sheperdsville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/411,496

(22) Filed: Oct. 4, 1999

(51) Int. Cl.[7] ..... D06F 37/42
(52) U.S. Cl. ..... 68/23.7; 68/23.6; 68/133
(58) Field of Search ..... 68/23.7, 23 R, 68/133, 23.6; 74/25, 36; 192/18 R, 12 B, 12 BA, 144

(56) References Cited

U.S. PATENT DOCUMENTS 1,855,056 A * 4/1932 Jorolemon
1,993,131 A * 3/1935 Borgna ..... 474/24
2,042,514 A * 6/1936 Diebold
2,152,755 A * 4/1939 Barnes ..... 425/19
2,364,393 A * 12/1944 Seeck
2,639,794 A * 5/1953 McNairy
2,826,056 A * 3/1958 Bruckman
2,911,962 A * 11/1959 McRae ..... 123/41.11
3,068,975 A * 12/1962 Theuer
3,090,472 A * 5/1963 Morrison
3,100,030 A * 8/1963 Mvmillan
3,110,189 A * 11/1963 Steuer ..... 474/18
3,145,574 A * 8/1964 Morgan
3,243,021 A * 3/1966 Pelensky
RE26,540 E * 3/1969 Kalns
3,750,533 A * 8/1973 Thoma ..... 91/498
3,812,943 A * 5/1974 Quemerais
3,818,729 A * 6/1974 Kenereich et al.
3,820,451 A * 6/1974 Tanaka ..... 100/4
4,095,685 A * 6/1978 McDonald et al. ..... 192/111 B
4,254,641 A 3/1981 Gauer et al.
4,283,928 A * 8/1981 Stone
4,301,666 A * 11/1981 Blevins
4,317,343 A 3/1982 Gerry
4,328,600 A * 5/1982 Bochan
4,329,859 A * 5/1982 Roberts
4,738,651 A * 4/1988 Favache et al. ..... 474/19
4,803,855 A 2/1989 Kennedy
4,969,341 A 11/1990 Burk et al.
5,033,278 A * 7/1991 Hossfield et al.
5,172,573 A 12/1992 Sharp et al.
5,209,085 A 5/1993 Brien
5,491,859 A 2/1996 Richardson
5,601,166 A * 2/1997 Beppu et al.
5,605,212 A * 2/1997 Hauser
5,743,467 A * 4/1998 Ban et al. ..... 237/12.3 R
5,791,448 A * 8/1998 Gochenour et al. ..... 192/70.25
6,148,646 A * 11/2000 Koshiga et al.
6,176,108 B1 * 1/2001 Bae et al.
6,244,078 B1 * 6/2001 Thompson et al.

* cited by examiner

*Primary Examiner*—Frankie L. Stinson
(74) *Attorney, Agent, or Firm*—George L. Rideout, Jr.; Armstrong Teasdale LLP

(57) ABSTRACT

A brake cam actuator assembly for a washing machine includes an actuator having a cylindrical body that is drivingly coupled to a transmission pulley hub through a wrap spring clutch circumscribing the transmission pulley hub and brake cam actuator body. A first end of the brake cam actuator includes a segmented ring that reduces knocking noises due to imperfections and manufacturing defects in the transmission pulley hub and brake cam actuator first end which interface one another. The segmented ring also forms controlled flow path for normal fluid leaks and prevents contamination of a ramped cam surface on a second end of brake cam actuator and contamination of a friction brake surface that may produce friction material squeaking noises.

21 Claims, 4 Drawing Sheets

WASHING MACHINE BRAKE CAM ACTUATOR WITH INTERRUPTED RING

BACKGROUND OF THE INVENTION

This invention relates generally to drive assemblies for washing machines, and, more particularly, to a brake cam actuator assembly for reducing noise in an agitate cycle of a washing machine.

One type of washing machine includes a wrap spring clutch that couples a brake cam actuator to a rotationally driven transmission pulley hub to execute an agitate portion of a washing machine cycle. See, for example, U.S. Pat. No. 4,283,928. The brake cam actuator operates to engage or disengage a brake that either prevents or allows, respectively, rotation of a clothes basket inside the machine. This particular construction, however, has proven disadvantageous in at least two aspects.

First, the assembly is susceptible to imperfections in the ends of the transmission pulley hub and brake cam actuator that are interfaced within the wrap spring clutch. Burrs and other imperfections on the surfaces may interfere as the transmission pulley hub and brake cam actuator are rotated with respect to one another, causing a high incidence of knocking noise in the agitate portion of a washer cycle. Factory rework of such machines and customer returns of defective units are contributing to an increased manufacturing cost of the machines.

Second, the brake cam actuator and transmission pulley hub typically form a sealing surface. Normal or expected fluid leaks, such as oil leaks, cannot penetrate the seal and therefore flow toward an opposite end of the brake cam actuator body and contaminate a cam surface of the brake cam actuator. Oil migrating from the cam surface of the brake cam actuator can further contaminate the friction brake surface. The contamination adversely affects operation of the brake, causing the brake to stick and/or slip, and producing squeaking noises in the agitate portion of the machine cycle.

Accordingly, it would be desirable to provide a brake cam actuator assembly that is not as sensitive to imperfections in the interfacing surfaces of the transmission pulley hub and the brake cam actuator and that reduces knocking noise in the agitate portion of a machine cycle. It would also be desirable to provide a brake cam actuator assembly that avoids contamination of the brake cam actuator cam surface friction material to prevent squeaking noise during the agitate portion of the machine cycle.

BRIEF SUMMARY OF THE INVENTION

In an exemplary embodiment of the invention, a brake cam actuator for a washing machine includes a cylindrical cam actuator body having first and second ends, and a ring attached to the first end that includes a plurality of segments separated from one another. More specifically, three equal arc segments extend about 95 rotational degrees around a circumference of the brake cam actuator first end. The arc segments are approximately equally spaced, and therefore separated from one another by about 25 rotational degrees around a circumference of the brake cam actuator first end.

The ring segments form a bearing surface that separate an end surface of a transmission pulley hub and a surface of the actuator body first end. The dimensions of the ring segments allow for an increased tolerance of edge imperfections and damage to the interfacing end of the transmission pulley hub and the brake cam actuator first end. Thus, instances of unacceptable knocking noise are reduced, and the ensuing factory reworks and customer returns are reduced accordingly.

The separation between the ring segments forms controlled flow paths for minor oil leaks to an outside surface of the cam actuator body. Therefore, contamination of the brake cam actuator bearing surface and the brake surface from minor oil leaks flowing to the second end is avoided. Consequently, the resultant squealing noise from sticking and slipping of a brake is reduced.

DETAILED DESCRIPTION OF THE INVENTION

Figure 1:
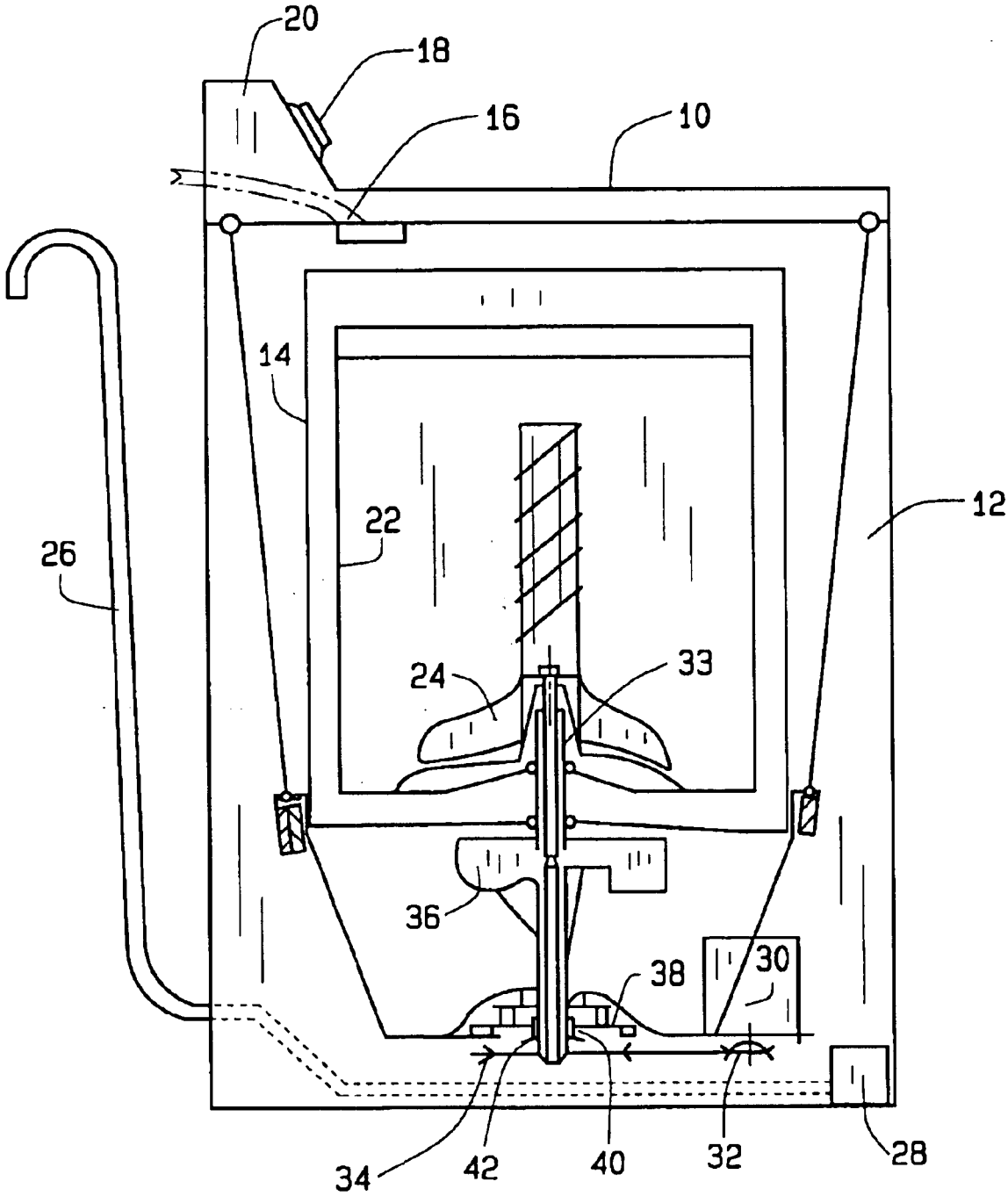
FIG. 1 is a side view of a washing machine partially broken away.

FIG. 1 is a partially broken away view of a conventional washing machine 10, the construction and operation of which is well known in the art, and in which the present invention may be practiced. Washing machine 10 includes a cabinet housing 12 including an outer tub 14 adapted to be filled with wash water or rinse water through a fill tube 16 in response to manipulation of controls 18 located on a control panel 20 for user selection of desired machine cycles.

A clothes basket 22 is mounted within outer tub 14 and clothes disposed in clothes basket 22 are subjected to washing action by an oscillating agitator 24 located within clothes basket 22 during a wash or rinse cycle after introduction of water into outer tub 14. After each wash or rinse cycle agitation, clothes basket 22 is rotated at high speed in order to extract water from the clothes. The water is drained into a sump (not shown), and pumped to a drain 26 by a pump assembly 28.

Agitator 24 and clothes basket 22 are driven by a single reversible electric dive motor 30 through a clutch 32 and a pulley system 34. Drive motor 30 drives a centrifugally actuated wrap spring clutch (not shown) drivingly connected to a transmission 36. Transmission 36 is normally braked by a spring applied disk brake 38 engaged by a brake cam actuator assembly 40 so that agitator 24 rotates while clothes basket 22 remains stationary. A transmission pulley hub 42 is coupled to pulley system 34 and interfaces with a brake cam actuator (not shown) and a brake cam actuator assembly wrap spring clutch (not shown) circumscribing the brake cam actuator and drivingly coupling transmission pulley hub 42 and the brake cam actuator to operate disk brake 38.

When drive motor 30 rotates transmission pulley hub 42 in a first direction, transmission 36 actuates agitator 24 to oscillate while brake cam actuator assembly engages disk brake to prevent clothes basket 22 from rotating. When drive motor 30 is reversed to rotate transmission pulley hub 42 in a second direction, transmission pulley hub 42 and the wrap spring clutch lock on the brake cam actuator and cause disk brake 38 to be released so that transmission pulley hub 42 spins transmission 36 coupled to clothes basket 22. Whenever clothes basket 22 is to be rotated for centrifugal extraction of liquid from clothes in clothes basket 22, brake cam actuator assembly 40 releases disk brake 38, allowing agitator 24 and clothes basket 22 to spin together.

Figure 2:
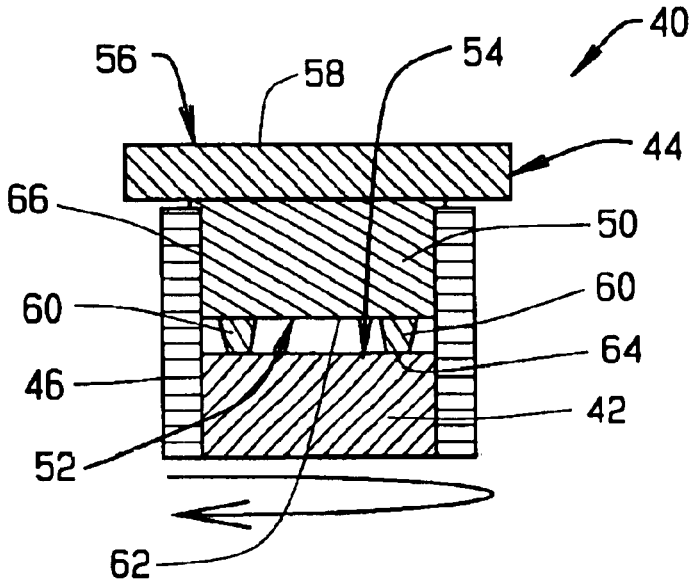
FIG. 2 is a schematic illustration of a brake cam actuator assembly including a brake cam actuator.

FIG. 2 is a schematic illustration of brake cam actuator assembly 40 including brake cam actuator 44, transmission pulley hub 42, and a wrap spring clutch 46. Brake cam actuator 44 includes a cylindrical body 50 having a first end 52 that interfaces with a transmission pulley hub end 54, and a second end 56 that forms a cam surface 58. A ring 60 is disposed between transmission pulley hub 42 and a first end surface 62 and is attached to brake cam actuator first end 52. Ring 60 is exaggerated in FIG. 2 to better illustrate the dual purpose of ring 60. First, ring 60 separates brake cam actuator first end surface 62 and transmission pulley hub end 54. Second, ring 60 forms a bearing surface 64 for transmission pulley hub end 54.

Wrap spring clutch 46 provides one-way engagement of transmission pulley hub 42 and brake cam actuator 44. When transmission pulley hub 42 is rotated clockwise, wrap spring clutch 46 engages an outer surface 66 of brake cam actuator body 50 and causes brake cam actuator 44 to rotate. When brake cam actuator 44 rotates, brake cam actuator second end cam surface 58 pushes upward and releases disk brake 38 (shown in FIG. 1), thereby allowing clothes basket 22 (shown in FIG. 1) to rotate with agitator 24 (shown in FIG. 1). When the rotation of transmission pulley hub 42 is reversed, i.e., when transmission pulley hub 42 is rotated counterclockwise by drive motor 30 (shown in FIG. 1), wrap spring clutch 46 slips on brake cam actuator outer surface 66 and a set of springs (not shown) pushes brake cam actuator 44 downward and engages disk brake 38 to prevent rotation of clothes basket 22 while agitator 24 rotates.

Figure 3:
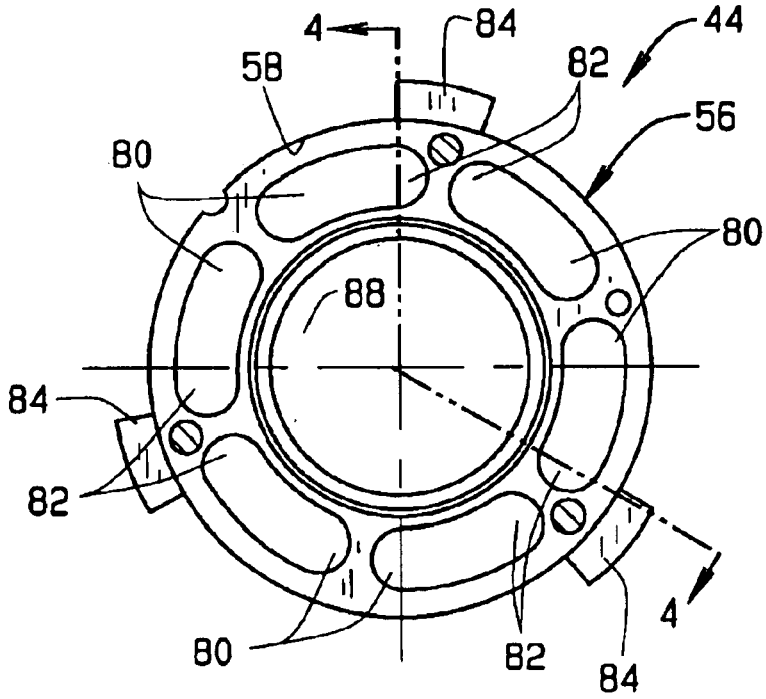
FIG. 3 is a top plan view of the brake cam actuator shown in FIG. 2.

FIG. 3 is a top plan view of brake cam actuator second end 56, including a plurality of ramped cam pockets 80 equally spaced around brake cam actuator cam surface 58 between spherical stops 82 for receiving ball bearings (not shown). A plurality of rotary stops 84 are positioned around an outer periphery 86 to limit the rotation of brake cam actuator 44 relative to disk brake 38 (shown in FIG. 1). A central aperture 88 is dimensioned for receiving and engaging transmission pulley hub 42. In operation, transmission pulley hub 42 drives brake cam actuator 44 through wrap spring clutch 46 (shown in FIGS. 1 and 2) in a clockwise direction, pushing the ball bearings upwards in ramped pockets 80 and releasing disk brake 38 (shown in FIG. 1). When the rotation of transmission pulley hub 42 is reversed, wrap spring clutch 46 slips on brake cam actuator body outer surface 66 and a spring (not shown) pushes the bearings downward in ramp pockets 80 and engages disk brake 38.

Figure 4:
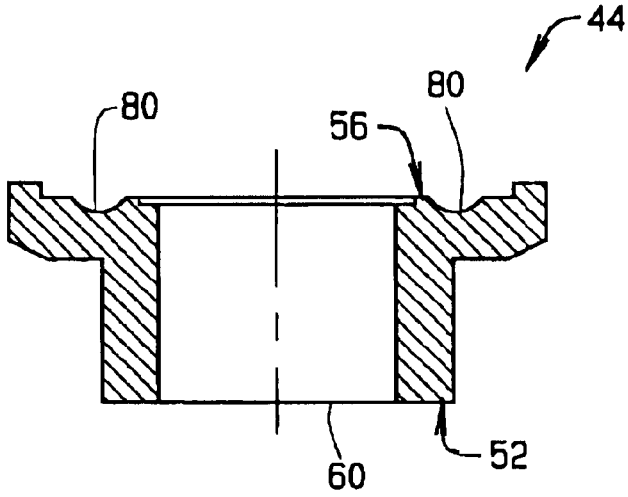
FIG. 4 is a cross sectional view of FIG. 3 taken along line 4—4.
Figure 5:
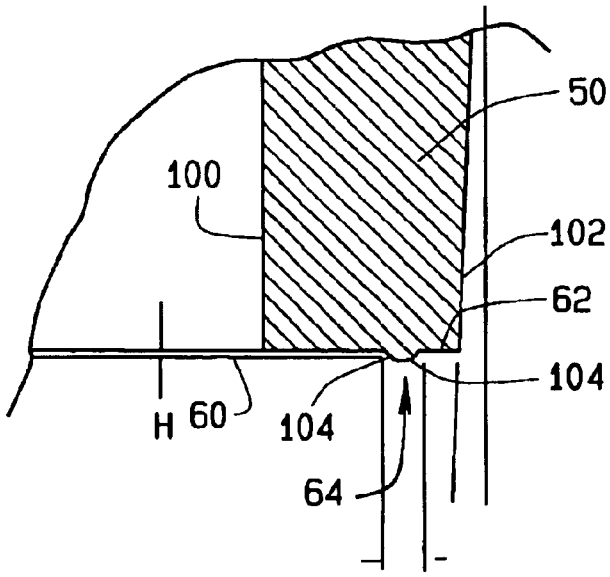
FIG. 5 is a magnified view of a portion of the brake cam actuator shown in FIG. 3.

FIG. 4 is a cross sectional view of brake cam actuator 44 along line 4—4 illustrating spherical ramped pockets 80 on brake cam actuator second end 56, and ring 60 on brake cam actuator first end 52, details of which are magnified in FIG. 5.

As shown in FIG. 5, ring 60 extends a distance H above brake cam actuator first end surface 62 and spans a radial distance W along brake cam actuator first end surface 62. Ring 60 extends between an inner edge 100 and an outer edge 102 of brake cam actuator body 50, and generally comprises two arcuate portions 104 extending from brake cam actuator first end surface 62 and joining a substantially flat bearing surface 64 for abutment with transmission pulley hub 42 (shown in FIGS. 1 and 2). In a particular embodiment, H is approximately 0.008 inches, W is approximately 0.04 inches, and arcuate portions 104 have a radius of approximately 0.02 inches. In a further particular embodiment, ring 60 is integrally formed with brake cam actuator body 50 and is fabricated from iron nickel sintered metal. Also, as shown in FIG. 5, brake cam actuator outer edge 102 is slightly tapered relative to brake cam actuator inner edge 100.

Figure 6:
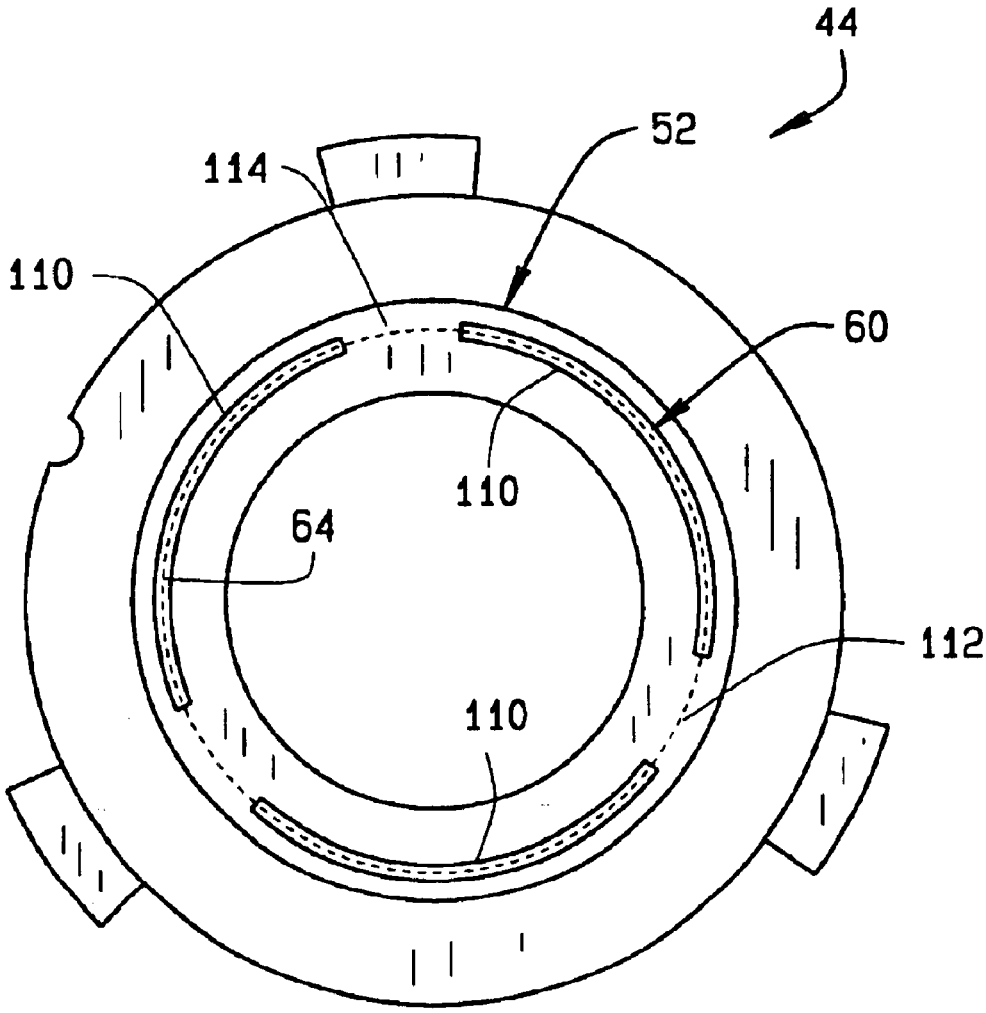
FIG. 6 is a bottom plan view of the brake cam actuator shown in FIG. 1.

FIG. 6 is a bottom plan view of brake cam actuator 44 illustrating ring 60 that includes a plurality of arc segments 110. Specifically, three equal arc segments 110 each span about 95 degrees of rotation around a circumference 112 of brake cam actuator first end 52, and are spaced from one another by about 25 degrees of rotation around circumference 112 of brake cam actuator first end 52. While arc segments 110 are equally sized and spaced as shown, it is contemplated that more or less segments, including linear segments, of varying size and shape could be employed within the scope of the instant invention.

In operation, ring bearing surface 64 contacts driven transmission pulley hub end 54 (shown in FIG. 2), thereby separating brake cam actuator first end surface 62 and decreasing the impact of imperfections and manufacturing defects in transmission pulley hub end 54 and brake cam actuator first end 52. Knocking noise from interfering imperfections on brake cam actuator first end 52 and transmission pulley hub end 54 is accordingly reduced.

Furthermore, separations 114 between ring segments 110 form controlled flow paths for normal oil leaks that allow oil to escape through the separations to brake cam actuator body outer surface 66. Consequently, oil does not flow into brake cam actuator second end 56 where it may contaminate cam surface 58 that may causes disk brake 38 (shown in FIG. 1) to stick and/or slip and produce squeaking noises during the agitate cycle of the machine.

Thus, a brake cam actuator assembly 40 is provided that is not as sensitive to imperfections in the interfacing surfaces of transmission pulley hub 42 and brake cam actuator 44 and that reduces knocking noise in the agitate portion of a machine cycle. Moreover, oil contamination of ramp areas in brake cam actuator second end 56 is avoided, and squeaking noise due to slipping and sticking of brake cam actuator 38 is reduced.

While the invention has been described in terms of various specific embodiments, those skilled in the art will recognize that the invention can be practiced with modification within the spirit and scope of the claims.

What is claimed is:

1. A brake cam actuator for a washing machine, comprising:

a cylindrical cam actuator body comprising first and second ends; and a ring attached to said first end, wherein said ring comprises a plurality of segments, extends from said first end, and is configured to separate said first end from an end of a transmission pulley hub, and said segments form a bearing surface.

2. A brake cam actuator in accordance with claim 3 wherein said plurality of segments comprises equally spaced arcs.

3. A brake cam actuator in accordance with claim 2 wherein said plurality of segments are spaced about 25° from one another around a circumference of said first end.

4. A brake cam actuator in accordance with claim 1 wherein said plurality of segments are equal in length.

5. A brake cam actuator in accordance with claim 4 wherein said segments extend about 95 degrees around a circumference of said first end.

6. A brake cam actuator in accordance with claim 1 wherein said plurality of segments comprises three segments.

7. A brake cam actuator in accordance with claim 1 wherein said ring is integral with said body.

8. A brake cam actuator in accordance with claim 1 wherein said body is tapered.

9. A brake cam actuator in accordance with claim 1 wherein said transmission pulley hub is coupled to a pulley system.

10. A brake cam actuator assembly, comprising:

a brake cam actuator comprising a body comprising first and second ends, said first end comprising a segmented ring;

a transmission pulley hub for driving said brake cam actuator first end, said segmented ring forming a bearing surface for said transmission pulley hub; and a wrap spring clutch circumscribing said body and said hub for driving engagement of said pulley and said hub in a first rotational direction, and for slipping engagement between said pulley and said hub in a second direction.

11. A brake cam actuator assembly in accordance with claim 10 wherein said first rotational direction is clockwise.

12. A brake cam actuator assembly in accordance with claim 10 wherein said segmented ring comprises a plurality of substantially equal arc segments.

13. A brake cam actuator assembly in accordance with claim 12 wherein said arc segments extend about 95 rotational degrees around a circumference of said first end.

14. A brake cam actuator assembly in accordance with claim 13 wherein said arc segments arm equally spaced from one another.

15. A brake cam actuator assembly in accordance with claim 10 wherein said ring is integrally formed with said body.

16. A brake cam actuator assembly in accordance with claim 10 wherein said second end comprises a plurality of ramps.

17. A brake cam actuator assembly in accordance with claim 10 wherein said body is tapered.

18. A brake cam actuator assembly in accordance with claim 10 wherein said segmented ring comprises three arc segments separated from one another by about 25 rotational degrees around a circumference of said first end.

19. A brake cam actuator in accordance with claim 9 further comprising a drive motor configured to drive an agitator via said pulley system.

20. A method for reducing noise in an agitate cycle of a washing machine, the washing machine including a brake cam actuator including a cylindrical body having first and second ends, a transmission pulley hub for driving engagement of said cam, and a wrap spring clutch circumscribing the transmission pulley hub and the brake actuator body for coupling rotation of the transmission pulley hub to the brake cam actuator body in at least one rotational direction, said method comprising the steps of:

forming a segmented ring on the first end of the cam actuator body, the ring comprising a plurality of arc segments separated from one another around a circumference of the first end, thereby increasing a tolerance of imperfections of the first end and forming controlled leak paths for minor oil leaks, directing oil away from the second end of the brake cam actuator; and assembling the transmission pulley hub, brake cam actuator and wrap spring clutch.

21. A method in accordance with claim 20 wherein said step of forming the segmented ring comprises the steps of integrally molding the brake cam actuator body and the ring.

* * * * *

UNITED STATES PATENT AND TRADEMARK OFFICE

CERTIFICATE OF CORRECTION

PATENT NO. : 6,860,124 B1
DATED : March 1, 2005
INVENTOR(S) : Abi-Habib et al.

It is certified that error appears in the above-identified patent and that said Letters Patent is hereby corrected as shown below:

Column 4,
Line 60, delete "3" and insert therefor -- 1 --.

Signed and Sealed this

Twenty-third Day of August, 2005

JON W. DUDAS
*Director of the United States Patent and Trademark Office*